US006765339B2

(12) United States Patent
Dieudonné et al.

(10) Patent No.: US 6,765,339 B2
(45) Date of Patent: Jul. 20, 2004

(54) INFRARED LAMP AND PROCEDURE FOR HEATING MATERIAL TO BE PROCESSED

(75) Inventors: Walter Dieudonné, Kleinostheim (DE); Joachim Scherzer, Bruchkobel (DE); Klaus Schmitz, Hanau (DE); Siegfried Grob, Hanau (DE)

(73) Assignee: Heraeus Noblelight GmbH, Hanau (DE)

( * ) Notice: Subject to any disclaimer, the term of this patent is extended or adjusted under 35 U.S.C. 154(b) by 90 days.

(21) Appl. No.: 10/301,612

(22) Filed: Nov. 22, 2002

(65) Prior Publication Data

US 2003/0076024 A1 Apr. 24, 2003

Related U.S. Application Data

(62) Division of application No. 09/516,940, filed on Mar. 1, 2000, now Pat. No. 6,534,904.

(30) Foreign Application Priority Data

Mar. 19, 1999 (DE) ..... 199 12 544

(51) Int. Cl.[7] ..... H01J 1/02; H01J 61/52; H01J 7/24; H01K 1/58

(52) U.S. Cl. ..... 313/45; 313/15; 313/37; 313/40; 445/46; 392/343; 392/391; 392/407; 315/46; 315/150

(58) Field of Search ..... 313/45, 15, 37, 313/38, 39, 40; 392/343, 346, 391, 393, 407, 411; 315/46, 150, 151; 445/19, 20, 48

(56) References Cited

U.S. PATENT DOCUMENTS

| | | | | | |
|---|---|---|---|---|---|
| 1,247,068 | A | * | 11/1917 | Benbow | 313/279 |
| 1,293,456 | A | * | 2/1919 | Johns | 219/207 |
| 2,384,704 | A | * | 9/1945 | Standing | 392/400 |
| 3,748,519 | A | * | 7/1973 | Martin et al. | 313/557 |
| 4,283,653 | A | * | 8/1981 | Brett | 313/341 |
| 4,316,116 | A | * | 2/1982 | Graves et al. | 313/344 |

(List continued on next page.)

FOREIGN PATENT DOCUMENTS

| | | | |
|---|---|---|---|
| GB | 2233150 | A | * 1/1991 |
| GB | 2278722 | A | * 12/1994 |

*Primary Examiner*—Ashok Patel
*Assistant Examiner*—Kevin Quarterman
(74) *Attorney, Agent, or Firm*—Oblon, Spivak, McClelland, Maier & Neustadt, P.C.

(57) ABSTRACT

An infrared lamp with a closed-off enveloping tube which encloses an emission source joined with contacts for a power supply in the form of a carbon ribbon which, extending in a direction of a long axis of the enveloping tube, determines an irradiation length of the infrared lamp in the sense of a higher irradiation output. The carbon ribbon has a length which is larger than the irradiation length by a factor of at least 1.5. With a procedure for heating a material to be processed using the infrared lamp, which makes possible short processing times in connection with a simultaneous high degree of energy efficiency, the infrared lamp may be operated such that its maximum emission lies within a wavelength range from 1.8 $\mu$m to 2.9 $\mu$m, and such that its power output comes to at least 15 Watts per $cm^3$ of the volume enclosed by the enveloping tube over the irradiation length.

5 Claims, 4 Drawing Sheets

U.S. PATENT DOCUMENTS 4,331,901 A * 5/1982 de Vrijer et al. ..... 313/315
4,413,205 A * 11/1983 Ooms ..... 313/579
4,517,491 A * 5/1985 Otto et al. ..... 313/579
4,535,269 A * 8/1985 Tschetter et al. ..... 313/579
4,678,959 A * 7/1987 Mewissen ..... 313/17
4,748,313 A * 5/1988 de Rudnay ..... 219/271
4,857,709 A * 8/1989 Janssen et al. ..... 219/459.1
4,942,331 A * 7/1990 Bergman et al. ..... 313/271
5,138,219 A * 8/1992 Krisl et al. ..... 313/112
5,254,902 A * 10/1993 Griffin et al. ..... 313/274
5,404,069 A * 4/1995 Olwert et al. ..... 313/279
5,430,353 A * 7/1995 Feldman et al. ..... 313/623
5,660,462 A * 8/1997 Bockley et al. ..... 362/256
5,889,367 A * 3/1999 Hofmann et al. ..... 313/634
5,907,663 A * 5/1999 Lee ..... 392/407
5,977,694 A * 11/1999 McGuire ..... 313/110
5,982,078 A * 11/1999 Krisl et al. ..... 313/112
6,225,731 B1 * 5/2001 Auyang ..... 313/25
6,239,550 B1 * 5/2001 Maeda ..... 313/579
6,577,816 B2 * 6/2003 Grob et al. ..... 392/407

* cited by examiner

INFRARED LAMP AND PROCEDURE FOR HEATING MATERIAL TO BE PROCESSED

CROSS-REFERENCE TO RELATED APPLICATIONS

The present application is a divisional of U.S. application Ser. No. 09/516,940 filed Mar. 1, 2000, now U.S. Pat. No. 6,534,904, and in turn is based on German patent application 199 12 544.9, the entire contents of both of which are hereby incorporated by reference.

BACKGROUND OF THE INVENTION

1. Field of the Invention

The present invention is directed to an infrared lamp with a closed-off enveloping tube which encloses an emission source joined with contacts for a power supply in the form of a carbon ribbon which extends in the direction of the long axis of the enveloping tube and determines an irradiation length of the infrared lamp. Furthermore, the present invention is directed to a procedure for heating a material to be processed using an infrared lamp which permits a heating rate of at least 250° C./second.

2. Discussion of the Background

An infrared lamp is known from GB-A 2 233 150 in connection with which the emission source is constructed in the form of an elongated carbon ribbon which extends from one face to an opposite face of a quartz glass enveloping tube closed at both ends. The carbon ribbon includes a great number of graphite fibers arranged parallel to one another and in the form of a ribbon. For electrical contact, the carbon ribbon is provided with metal end caps on both sides. Usually, the ends of the carbon ribbons are clamped into the end caps. The caps are joined with a metal wire bent into a spiral, which engages on an electrical bushing projecting through closed faces of the enveloping tube. The irradiation length of the infrared lamp results directly from the length of the carbon ribbon.

The carbon ribbon allows a rapid temperature change of at least 250° C./second, so that the background infrared carbon lamps are distinguished by a high rapidity of reaction. Nonetheless, the radiation output of a radiating body greatly depends upon its temperature in accordance with the Stefan-Boltzmann Law,—i.e. it recedes considerably with diminishing temperature. The background carbon lamp can indeed be used at high temperatures around 1450 K. In this case, however, it should be assured that the quartz glass enveloping tube does not come into contact with the hot carbon ribbon. In contrast, if the carbon lamp is operated at temperatures below the load limit of quartz glass (about 1270° K), then the radiation output diminishes according to the Stefan-Boltzmann Law.

SUMMARY OF THE INVENTION

One object of the present invention is to provide a novel infrared lamp which can increase radiation output.

A further object of the present invention is to provide a novel procedure for the use of an infrared lamp for processing material layers which facilitate short treatment times with a simultaneously high degree of energy efficiency.

With respect to the novel infrared lamp, the present invention achieves the above and other objects by providing a novel infrared lamp in which a carbon ribbon has a length which is greater than an irradiation length by at least a factor of 1.5.

"Irradiation length" is understood to mean the longitudinal segment of the infrared lamp which contributes directly to heating. This longitudinal segment extends between the ends of the enveloping tube which are not heated. While with a background infrared lamp the length of the carbon ribbon corresponds to the irradiation length, the length of the carbon ribbon of the infrared lamp of the present invention is at least 1.5 times as long as the irradiation length. In this way, in the present invention an enlargement of the emitting surface over the irradiation length by the factor of 1.5 is attained, resulting in a corresponding increase in irradiation output in connection with the same surface temperature, according to the Stefan-Boltzmann Law. Consequently, with the novel infrared lamp of the present invention, high output densities are attainable even at low operating temperatures, e.g., at least 15 Watts per $cm^3$ of the volume enclosed by the enveloping tube over its irradiation length.

The higher output density achieved in the present invention has very advantageous results in several respects. The infrared lamp of the present invention permits rapid heating of at least 250° C./second and rapid cooling, and consequently behaves, with respect to its rate of temperature change, similarly to short wave infrared lamps. The maximum emission, however, of short wave infrared lamps usually lies in the wavelength range between 0.9 $\mu$m and 1.8 $\mu$m. In contrast, with the novel infrared lamp of the present invention, the maximum emission may lie in the wavelength range from about 2.3 $\mu$m to 2.9 $\mu$m due to the lower operating temperatures below about 1220 K. This wavelength range agrees with the wavelength range of about 1.8 $\mu$m to 4 $\mu$m, within which water-containing processing material has its maximum absorption. Due to the increased irradiation output of the novel infrared lamp of the present invention, a comparatively low energy rate suffices for operating the novel infrared lamp in this wavelength range. This leads to a corresponding low heating of the lamp surroundings. Consequently, it surprisingly appears that the efficiency with infrared treatment of a conventional processing material can be improved with the novel infrared lamp of the present invention, and that the energy requirement can at the same time be lower than with background short wave infrared lamps.

Enlarging the surface of the carbon ribbon in comparison with a simple elongated construction is achieved in the present invention through special geometrical shaping of the carbon ribbon, such as by folding, bending, rolling, or twisting the carbon ribbon. The length of the carbon ribbon corresponds at most to 66.67% of the length of the carbon ribbon in its elongated form after this shaping.

A carbon ribbon with a spiral construction has proven especially advantageous. As a consequence of the spiral shape, the surface of the emission source is significantly larger than the surface of a cylinder-shaped extended ribbon of equal length. With the spiral shape, the outward radiating surface is relevant for the power output which, apart from the gap between the windings, has approximately the shape of a cylindrical casing surface. In this case, it is important in the sense of the present invention that the surface radiating outward be larger than the irradiation length by at least a factor of 1.5. The larger surface once again leads to a higher irradiation output at a given surface temperature.

In equally preferred embodiments, the carbon ribbon can be folded like an accordion or bent into a wave-like shape. It is important that such special shapes result in a length of the carbon ribbon which is larger than the irradiation length by at least a factor of 1.5. The thickness of the carbon ribbon usually lies in the range between 0.1 mm and 0.5 mm, and its width in the range between 2 mm and 2.5 mm.

With respect to the procedure for heating the material to be processed using an infrared lamp, the objective indicated above is accomplished in that the novel infrared lamp of the present invention is operated such that its maximum emission lies at a wavelength ranging from 1.8 μm to 2.9 μm, and such that its power output reaches at least 15 Watts per $cm^3$ of the volume enclosed by the enveloping tube over its irradiation length.

Heating a treatment material by the infrared lamp can, for example, result in drying, hardening, softening, or fusing. The indicated wavelength from 1.8 μm to 2.9 μm goes along with a surface temperature in the range from about 1250 K to about 1000 K. Owing to the comparatively large surface of the emission source, high output densities are attainable with the novel infrared lamp even at these relatively low operating temperatures. In accordance with the present invention, a power output of at least 15 Watts per $cm^3$ of the volume of the enveloping tube enclosed over the irradiation length is set for heating the treatment material, whereby this power output basically includes a wavelength range from about 1.8 μm to 4 μm, within which a water-containing treatment material usually has its maximum absorption. For the operation of the novel infrared lamp, therefore, not only is comparatively low energy use achieved, but in particular its wavelength range accords well with an application-specific wavelength range of about 1.8 μm to 4 μm. In this way, the irradiation durations for the desired heating are short. With such a mode of operation of the novel infrared lamp, the degree of effectiveness for heating a treatment material is consequently better than with background short wave infrared lamps. In particular, the energy requirement for heating is lower and the treatment duration is shorter.

A procedure is especially preferred in connection with which the maximum emission wavelength ranges from 2.3 μm to 2.7 μm. With an operating mode of the novel infrared lamp of the present invention in this wavelength range, an especially high degree of energy efficiency with a short treatment duration is attained.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
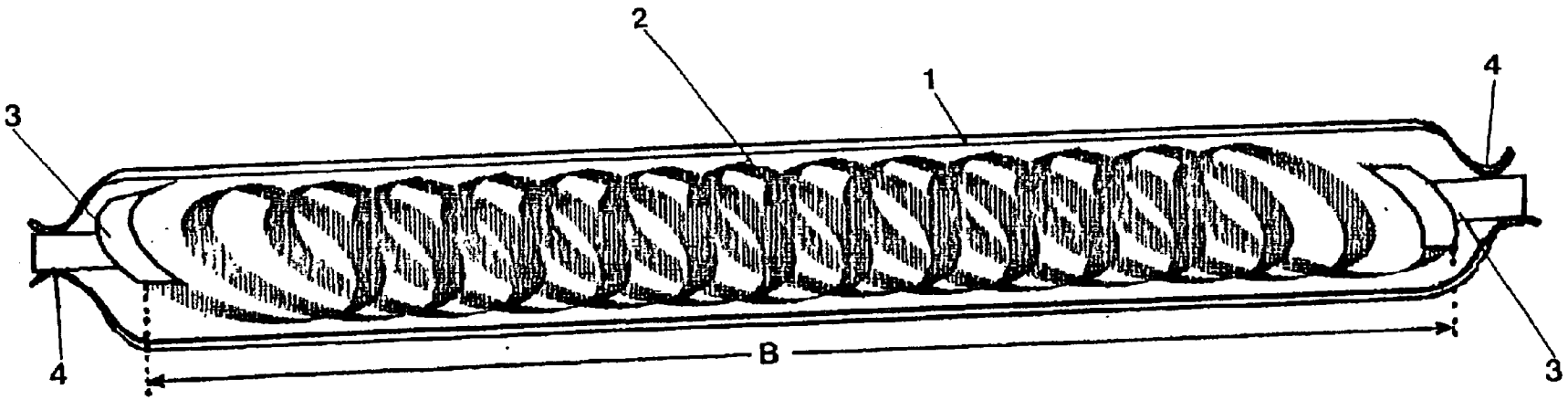
FIG. 1 shows in schematic representation an infrared lamp of the present invention with an emission source in the form of a spiral-shaped carbon ribbon.

Referring now to the drawings, wherein like reference numerals designate identical or corresponding parts throughout the several views, and more particularly to FIG. 1 thereof, a first embodiment of the infrared lamp of the present invention is shown.

The infrared lamp represented schematically in FIG. 1 is directed to a medium wave infrared lamp with a maximum emission in the wavelength range from 2.0 to 2.9 μm. Within an evacuated enveloping tube 1 of quartz glass, a heater element is arranged in the form of a spiral-shaped carbon ribbon 2. The enveloping tube 1 may have an inner diameter of 16 mm and a length of 110 cm. The ends of the enveloping tube 1 are closed by pinches 4 through which metallic contact elements 3 are passed for the electrical connection to the carbon ribbon 2.

The carbon ribbon 2 may have a thickness of 0.15 mm and a width of 11 mm. The ends of the carbon ribbon 2 are joined to the metallic contact elements 3. The spiral formed by the carbon ribbon 2 may circumscribe an outer circle with an outer diameter of 15 mm. The gap between the windings may come to about 2 mm. The spiral extends over the entire irradiation length "B" of the infrared lamp, which may amount to 100 cm. The actual length of the carbon ribbon 2, however, in extended form may be about 360 cm. Consequently, with the spiral-shaped carbon ribbon 2, a surface within the irradiation length "B" of the enveloping tube 1 is made available which overall is larger by about a factor of 3.6 (in comparison with a form of construction of the carbon ribbon merely stretched over the irradiation length "B"), of which the surface irradiating toward the outside of the infrared lamp nonetheless only includes a portion, so that the surface enlargement which is really effective for the output increase in comparison with the elongated form of construction is at about a factor of 2. Correspondingly, a radiation output which is twice as high is made available, which is clearly noticeable at low temperatures below 1220 K. The spiral shaped carbon ribbon 2 is therefore especially suited for manufacturing an infrared lamp of the present invention. The infrared lamp permits rapid temperature change; heating rates of more than 250° C./second are possible. The volume of the enveloping tube 1 enclosed over the irradiation length B may amount to about 200 $cm^3$ in this embodiment.

An embodiment for an operating mode is now described in greater detail below on the basis of the infrared lamp shown in FIG. 1.

The infrared lamp of FIG. 1 may be used for heating a ribbon-shaped material in a continuous heating furnace. The main absorption bands of the ribbon-shaped material to be heated may lie in the range between 1.8 μm and 4 μm. The infrared lamp of the present invention may be operated so that its maximum emission wavelength lies at about 2.4 μm. Moreover, the infrared lamp may emit an output of about 40 Watts per cm of lamp length, in the embodiment thus about 4000 Watts overall, which corresponds to about 20 W per $cm^3$ of the volume of the enveloping tube 1 enclosed over the irradiation length B. For a 1 $m^2$ large heating field, an outfitting with 20 infrared lamps of this type consequently yields a surface output of 80 $kW/cm^2$. The indicated wavelength range of 2.4 μm corresponds to a surface temperature in the range of about 1200 K. Due to the comparatively large surface of the carbon ribbon 2 in the present invention, high output densities of about 80 $kW/m^2$ are attainable with the infrared lamp of the present invention even at these relatively low operating temperatures. Owing to the high output density in the range of the main absorption bands of the material to be heated, high processing rates are possible above and beyond this.

With this mode of operation of the infrared lamp of the present invention, the degree of efficiency for heating a processing material is better than with short wave infrared lamps. In particular, the energy requirement for heating is lower and the treatment duration is shorter.

As a further example of a procedure to which the infrared lamp of the present invention is applicable, the infrared lamp of the present invention may be used for welding plastic molded parts. For that procedure, the maximum emission of the carbon ribbon 2 may be set to a wavelength of 2.5 μm. The main absorption bands of the plastic to be heated may lie at 3 to 4 μm. The infrared lamp of the present invention may be so operated that its maximum emission lies at a wavelength of about 2.9 μm. Moreover, the infrared lamp may emit an output of about 36 Watts per cm of lamp length, thus about 3600 Watts overall in such an embodiment, which corresponds to about 18 W per $cm^3$ of the volume of the enveloping tube 1 enclosed over the irradiation length B. For a 1 $m^2$ large heating field outfitted with 20 infrared lamps of this type, a surface output of 72 $kW/m^2$ consequently arises. Owing to the high output density in the range of the main absorption bands of the plastic to be heated, high process speeds are thereby possible.

Figure 2:
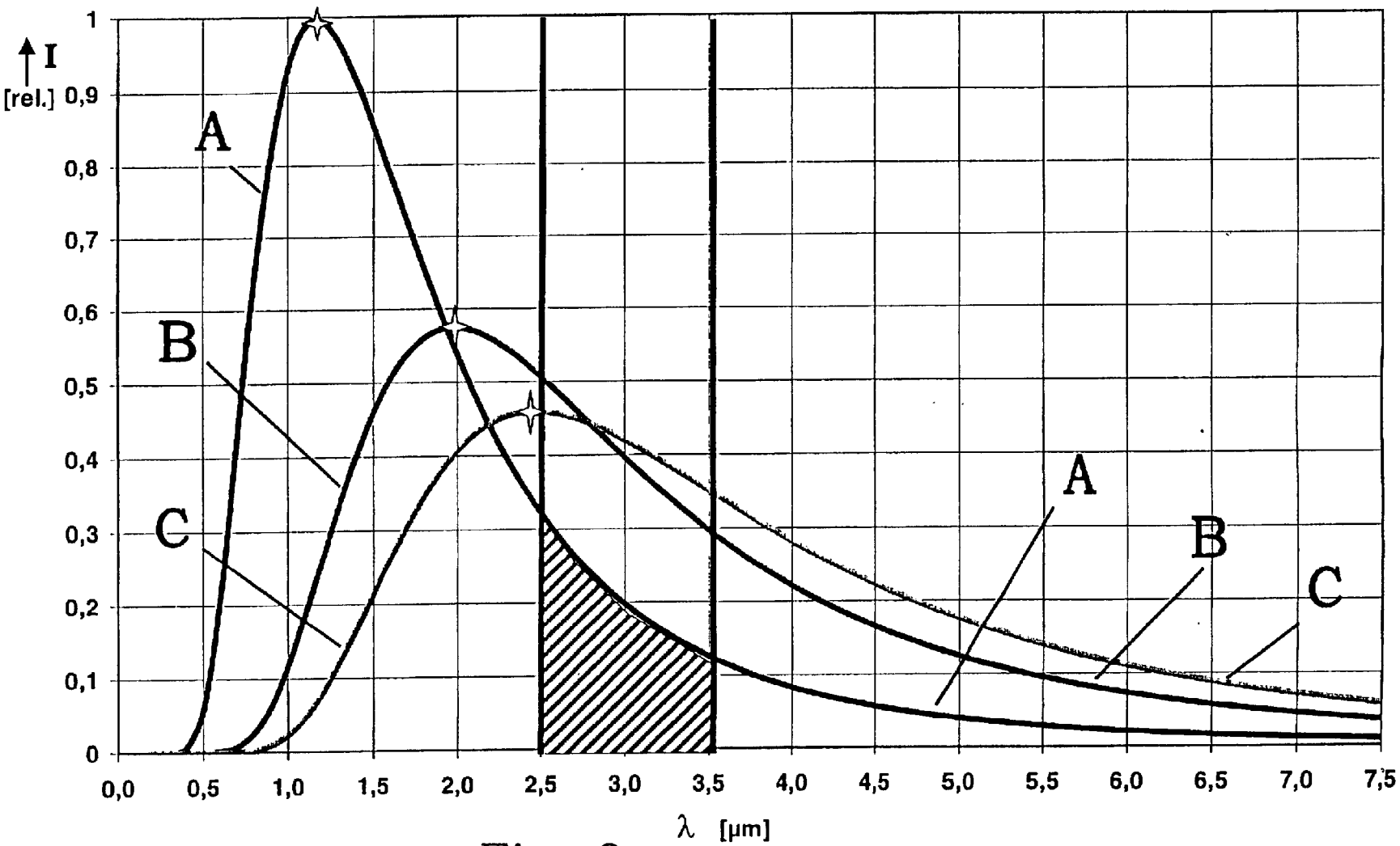
FIG. 2 is a diagram of typical spectral radiation distributions of three infrared lamps.

With reference to the diagram shown in FIG. 2, the advantageous action of the infrared lamp of the present invention is further explained. In FIG. 2, spectral irradiation distributions of a typical short wave infrared lamp (curve A), a typical carbon lamp with an operating temperature of the carbon ribbon of 1500 K (curve B), and a carbon lamp of the present invention with the spiraled carbon ribbon 2 as it is represented in FIG. 1, with an operating temperature of 1200 K (curve C), are represented. The intensity of spectral emission in accordance with the Stefan-Boltzmann Law is plotted on the Y axis in relative units ($kW/m^2$ scaling), and the wavelength range from 0 to 7.5 μm is plotted on the X axis. All of these infrared lamps are distinguished in like manner in that they can be heated up very rapidly (the heating speed may reach at least 250° C./second). The areas under the curves A, B, and C are equal in each case, meaning that the emitted optical output is equal with all three of the infrared lamps. The maximum emission of curve A lies at about 1.5 μm, that of curve B lies at about 2 μm, and that of curve C lies at about 2.5 μm. Nonetheless, the spiral components in an application-specific wavelength range are decisive within which a water-containing treatment material usually has absorption maxima, and which lies between 1.8 μm and 4 μm. Particularly relevant is the wavelength range between 2.5 μm and 3.5 μm which is bounded by bold vertical lines in FIG. 2. In this wavelength range, the curves A, B, and C differ. With a typical short wave infrared lamp in accordance with curve A, the corresponding spectral component, which is characterized by the cross-hatched area under curve A, is smallest, while this spectral component is largest in the infrared lamp of the present invention in accordance with curve C despite equal output. From such a difference results the above-mentioned advantageous effects of the infrared lamp of the present invention, in particular the large energy saving potential.

The embodiment of the present invention as discussed above with respect to FIG. 1 shows the carbon ribbon 2 with a spiral shape. The present invention is not limited to that particular shape of the spiral ribbon 2. Other examples of the shape that a carbon ribbon can take in the present invention are shown in FIGS. 3 and 4.

Figure 3:
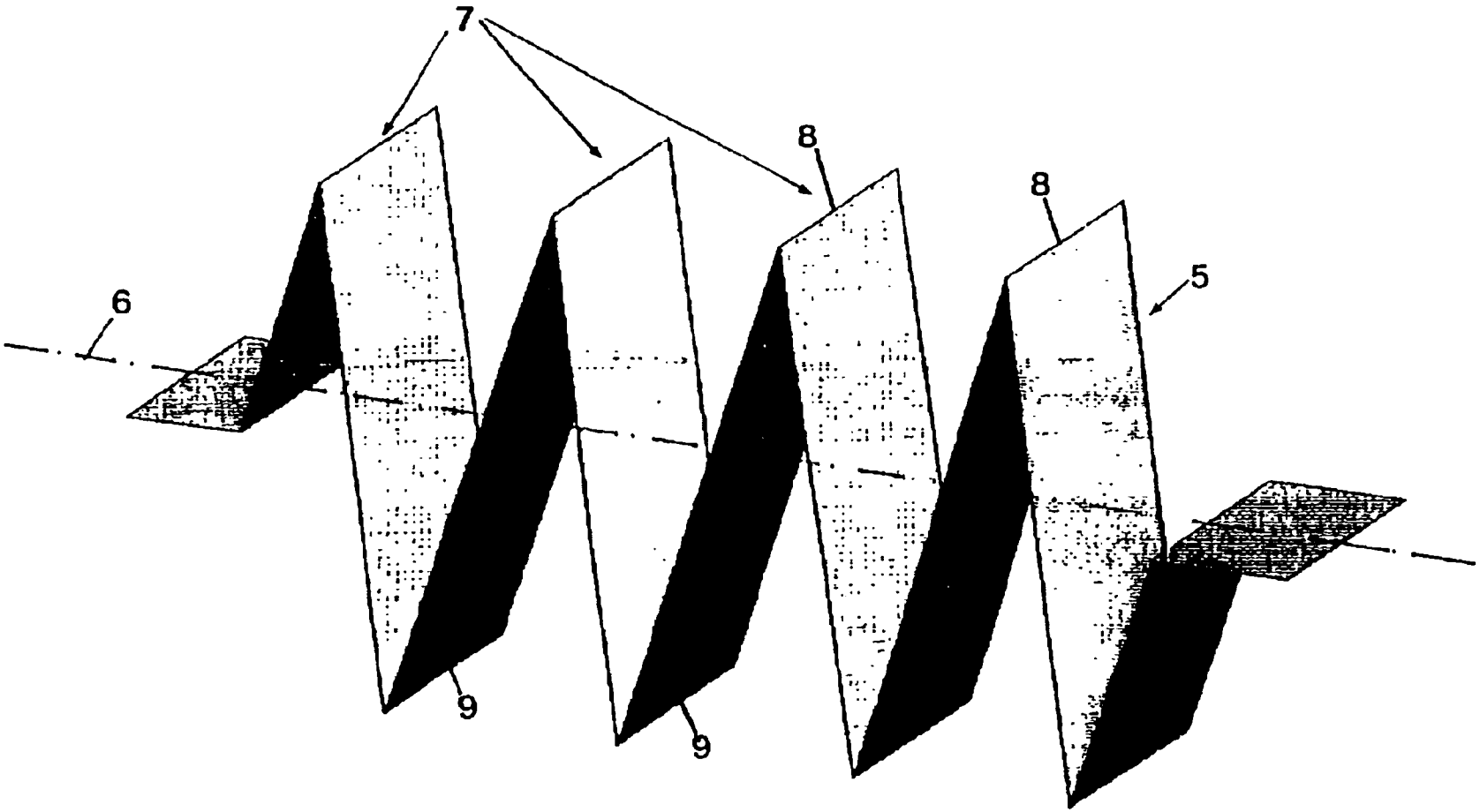
FIG. 3 illustrates a carbon ribbon folded in an accordion-like shape in schematic representation as a further embodiment of the present invention.

In FIG. 3, a carbon ribbon 5 according to a further embodiment of the present invention includes a plurality of folds 7 and is thus folded in an accordion fashion and may have a thickness of 0.15 mm and a width of 10 mm. The carbon ribbon 5 is folded across its long axis 6. In the embodiment of FIG. 3, four equal folds 7 are provided, whereby each of the folds includes an upper kink site 8 above the long axis 6 and a lower kink site 9 below the long axis 6. The distance between the upper kink site 8 and the lower kink site 9 may amount to about 11 mm for each fold. The folded carbon ribbon 5 may extend over an irradiation length of about 8 cm. The actual length of the carbon ribbon 5 in the stretched-out form may be about 12.5 cm. Consequently, a surface larger by a factor of about 1.5 is made available within the irradiation length through the folded carbon ribbon 6 (in comparison with a form of construction of a carbon band stretched along the long axis 6), and consequently facilitates an irradiation output which is higher by the same factor.

Figure 4:
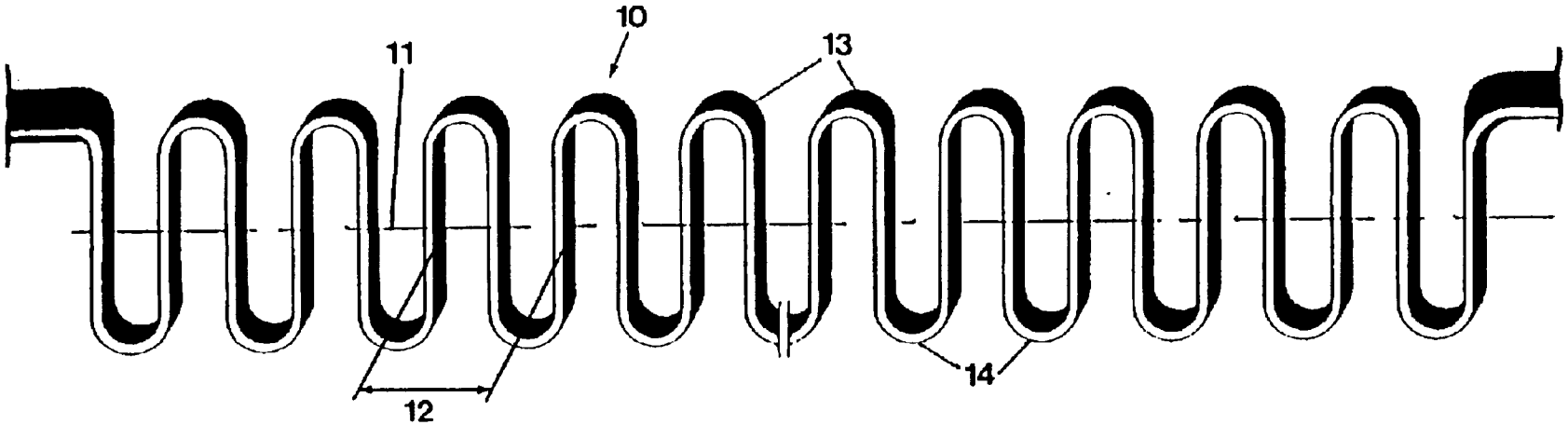
FIG. 4 shows a wave-shaped carbon ribbon in schematic representation as a further embodiment of the present invention.

A wave-shaped carbon ribbon 10 according to a further embodiment of the present invention is schematically represented in FIG. 4 and may have a thickness of 0.15 mm and a width of 10.5 mm. The carbon ribbon 10 is bent wave-like across its long axis 11. In the embodiment of FIG. 4, 19 identical waves 12 are provided, whereby each of the waves 12 includes a wave crest 13 above the long axis 11 and a wave trough 14 below the long axis 11. The carbon ribbon length between wave crest 13 and wave trough 14 may come to about 33 mm in each case. The bent carbon ribbon 10 may extend over an irradiation length of about 41 cm. The actual length of the carbon ribbon 10 in stretched-out form may lie at about 64 cm. Consequently, the undulated carbon ribbon 10 (in comparison with a form of construction of the carbon ribbon stretched along the long axis 11) makes possible a surface which is larger by approximately a factor of 1.5 than the irradiation length, and correspondingly a radiation output which is higher by the same factor.

Obviously, numerous modifications and variations of the present invention are possible in light of the above teachings. It is therefore to be understood that within the scope of the appended claims, the present invention may be practiced otherwise than as specifically described herein.

What is claimed is:

1. A process for heating a material to be processed using an infrared lamp with a closed enveloping tube including an emission source joined with contacts for a power supply in the form of a carbon ribbon which, extending in a direction of the long axis of the enveloping tube, determines an irradiation length of the infrared lamp, wherein the carbon ribbon has a length which is greater than the irradiation length by at least a factor of 1.5, which permits a heating rate of at least 250° C./second, the process comprising the step of:

operating the infrared lamp such that its emission maximum lies with a wavelength in a range from 1.8 μm to 2.9 μm, and in that its power output reaches at least 15 Watts per $cm^3$ of volume enclosed by the enveloping tube over the irradiation length.

2. A process according to claim 1, wherein the carbon ribbon has a spiral shape.

3. A process according to claim 1, wherein the carbon ribbon includes a plurality of folds.

4. A process according to claim 1, wherein the carbon ribbon is bent to have a wave-like shape.

5. A process according to claim 1, wherein the maximum emission wavelength ranges from 2.3 μm to 2.7 μm.

* * * * *